United States Patent [19]

Kite et al.

[11] 4,131,117

[45] Dec. 26, 1978

[54] METHOD FOR REMOVAL OF POTASSIUM NITRATE FROM TOBACCO EXTRACTS

[75] Inventors: George F. Kite, Richmond; Grant Gellatly, Chester; Richard G. Uhl, Highland Springs, all of Va.

[73] Assignee: Philip Morris Incorporated, New York, N.Y.

[21] Appl. No.: 753,066

[22] Filed: Dec. 21, 1976

[51] Int. Cl.[2] ..... A24B 3/14

[52] U.S. Cl. ..... 131/140 C; 131/143; 423/194; 423/208

[58] Field of Search ..... 131/17 A, 140 R, 143, 131/140 C; 423/208, 395, 194; 23/302 R, 299; 71/59

[56] References Cited

U.S. PATENT DOCUMENTS

| | | | |
|---|---|---|---|
| 720,830 | 2/1903 | Marsden | 131/143 |
| 1,922,283 | 8/1933 | Dering | 23/302 |
| 2,616,785 | 11/1952 | Butchart | 23/302 |
| 3,369,552 | 2/1968 | Carroll | 131/143 |
| 3,398,754 | 8/1968 | Tughan | 131/143 |
| 3,428,053 | 2/1969 | Schoenbaum et al. | 131/140 C |
| 3,616,801 | 11/1971 | Hind | 131/143 |
| 3,847,163 | 11/1974 | Molyneux | 131/143 |
| 3,847,164 | 11/1974 | Mattina et al. | 131/143 |
| 3,983,222 | 9/1976 | Lehto | 23/302 R |

OTHER PUBLICATIONS

Kirk-Othmer, Encyclopedia of Chemical Technology, Second Edition, vol. 16 (1969), pp. 393, 394.

*Primary Examiner*—O. R. Vertiz
*Assistant Examiner*—Wayne A. Langel
*Attorney, Agent, or Firm*—Arthur I. Palmer, Jr.; George E. Inskeep; Susan A. Hutcheson

[57] ABSTRACT

This disclosure relates to a process for selectively removing and recovering potassium nitrate in a relatively pure state from tobacco, and especially from Burley tobacco stems. The process comprises the steps of (1) contacting tobacco plant parts with water to obtain an aqueous extract and a fibrous tobacco residue, (2) concentrating the extract, (3) cooling the extract, and (4) separating and recovering the potassium nitrate crystals formed therein. The denitrated aqueous extract is recombined with the fibrous tobacco residue as in making reconstituted tobacco and the like. The purified potassium nitrate is suitable without further purification to use as a fertilizer, thus eliminating costly disposal problems.

1 Claim, 1 Drawing Figure

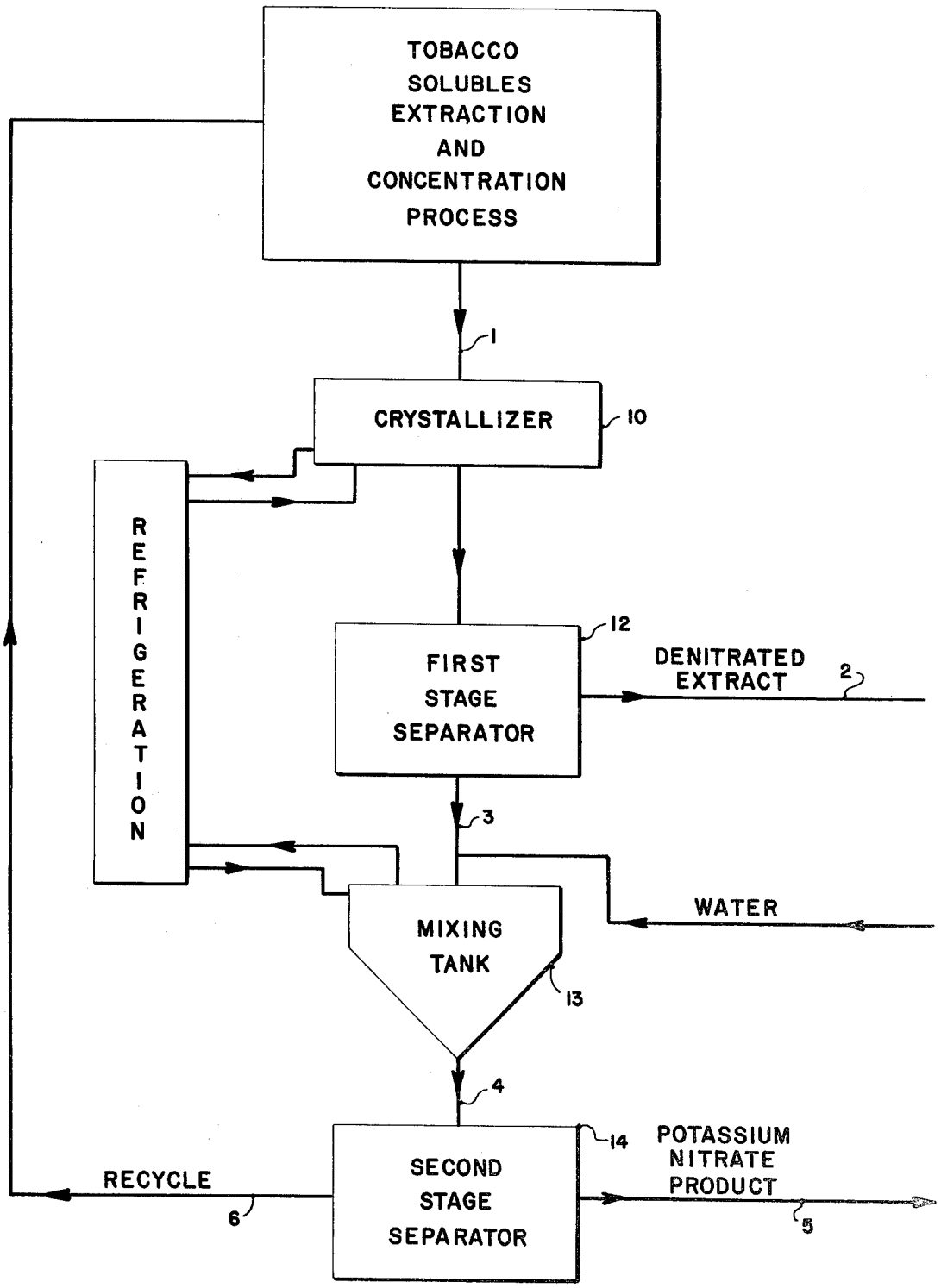
TOBACCO SOLUBLES EXTRACTION AND CONCENTRATION PROCESS
1
CRYSTALLIZER
10
REFRIGERATION
12
FIRST STAGE SEPARATOR
DENITRATED EXTRACT
2
3
WATER
MIXING TANK
13
4
14
POTASSIUM NITRATE PRODUCT
RECYCLE
6
SECOND STAGE SEPARATOR
5

METHOD FOR REMOVAL OF POTASSIUM NITRATE FROM TOBACCO EXTRACTS

BACKGROUND OF THE INVENTION

Various processes for making reconstituted tobacco are known in the art. Many of these processes include an aqueous extraction of the tobacco plant parts followed by treatment of the extract and subsequent recombination of the thus treated extract with tobacco pulp. A particularly preferred treatment of the tobacco extract involves removal of some of the inorganic constituents from the extract prior to its recombination with the fibrous tobacco pulp. Potassium nitrate removal is particularly desirable for several reasons. First, the burn rate of the tobacco products will be diminished; and secondly, some of the products of combustion, such as oxides of nitrogen, are reduced. Furthermore, the reconstituted tobacco will have a lowered bulk density per unit weight and an improved filling capacity.

Removal of constituents present in aqueous tobacco extracts has been dealt with for many years, and various methods have been proposed. For example, U.S. Pat. No. 720,830 to Marsden describes a method for treating an aqueous tobacco extract by subjecting the extract to heating under pressure so as to flash off the liquid constituents such as "fusel oil." The solid residue is dissolved in water, and the mixture is boiled until the mineral matter consisting of sodium nitrate, some of the potassium nitrate, and other mineral matter crystallizes out and is separated from the liquor. The Marsden patent fails to describe or suggest an important aspect of the present invention which is to recover potassium nitrate in a relatively pure and useful form. In addition, the use of heat in excess of 250° F. in the Marsden process results in the loss of many desirable volatile tobacco flavorants in the flash distillation step and the subsequent boiling of the extract.

U.S. Pat. No. 3,428,053 describes a centrifugation step which removes a significant amount of the solid insoluble constituents from the aqueous extract prior to concentration and reapplication to the tobacco sheet. The identity of the thus separated solids was not elucidated; however, it is believed that very little, if any, of the water-soluble potassium nitrate could be removed or recovered by using this method.

U.S. Pat. Nos. 3,616,801 and 3,847,164 describe methods wherein ion exchange and ion retardation resins are utilized to selectively remove inorganic constituents and are specifically directed to the removal of potassium nitrate from aqueous extracts of tobacco. However, no attempt was made to recover the potassium nitrate in a useful form. These particular methods may be feasible on a small scale but are apt to be both costly and cumbersome on a practical commercial scale. In addition, regeneration of the ion exchange resin or disposal of the resin containing the crude potassium nitrate and other undesirable elements adds to the cost and also presents a problem from an ecological and environmental viewpoint.

SUMMARY OF THE INVENTION

In accordance with the present invention, it has been found that by cooling a concentrated aqueous tobacco extract, potassium nitrate readily crystallizes and may be recovered by conventional methods such as centrifugation, filtration, and the like. The denitrated extract is then returned to the fibrous tobacco pulp or web according to known methods for the production of reconstituted tobacco. The recovered crude potassium nitrate may be treated by washing with water to avoid loss of tobacco solubles subsequently used in the reconstitution process. The purified potassium nitrate separated from the wash water by filtration or centrifugation is useful as a fertilizer. This approach obviates the problems of potential pollution or expensive disposal of large amounts of tobacco waste by-products. In addition, the present invention provides an efficient and continuous process for denitrating aqueous tobacco extracts.

It is, therefore, an object of this invention to provide an improved process for the treatment of tobacco and tobacco waste products which comprises extracting water-soluble constituents from tobacco and recovering potassium nitrate at approximately 91 ± 6% purity on a dry weight basis. It is a further object of the invention to provide a continuous process for the selective removal of potassium nitrate from aqueous tobacco extracts, especially Burley stem extracts, by crystallization of the potassium nitrate. The thus isolated potassium nitrate waste product may be dried and pelletized, if desired, and used as a fertilizer.

DESCRIPTION OF THE PREFERRED EMBODIMENTS

Other objects, advantages, and details will appear as the following more detailed description of the invention proceeds. The tobacco used in the denitrating process may be any type of tobacco, tobacco blend, or tobacco plant parts such as ground or pulverized stems, stalks, midribs, lamina, and other tobacco components. Of all tobacco components, the nitrate-nitrogen content of Burley stems is highest (1–3%) and Burley lamina intermediate (0.5–1.5%). Reduction of the nitrate-nitrogen content of tobacco extracts obtained from the aforementioned components to about 0.3% can be realized by the process of the present invention.

The level to which nitrate-nitrogen can be reduced is generally governed by the solubility of potassium nitrate in tobacco solubles. The solubility of potassium nitrate is influenced by (a) temperature, (b) common ion effect, and (c) the concentration of the tobacco solubles extract. Maximum reduction of the nitrate-nitrogen content of a tobacco blend can advantageously be achieved by treating only the Burley fraction. In addition, Burley stems and midribs are particularly preferred so that increased potassium nitrate recovery may be realized. Alternatively, any type of tobacco or tobacco mixture may be processed using the present invention.

For a more complete understanding of the invention, reference will now be made to the accompanying drawing in which a schematic flow diagram is given which illustrates the presently preferred procedure of this invention. A concentrated aqueous tobacco extract obtained by conventional methods well known in the art and having an approximate total solids content of about 30% to about 70% and a nitrate-nitrogen content of about 1% to 3% is fed into a refrigerated crystallizer 10. A preferred apparatus for cyrstallization is a jacketed pipe equipped with rotating scraper blades which clean the walls therein and ensure efficient heat transfer. Refrigerant is circulated through the jacket to effectively cool the concentrated extract.

Maximum crystallization of potassium nitrate is achieved by cooling the extract to about 5° F. to 25° F.

and preferably to about 10° F. to 15° F. At temperatures below 0° F. to 5° F., the concentrated extract tends to freeze. Extracts containing predominantly Burley tobacco components may be chilled to about 4° F. to 6° F. without freezing, whereas extract containing various other tobacco blend solubles should be maintained above 8° F.

The resultant crystalline material in admixture with extract liquor is fed to a first stage separator 12 which may be a filtering apparatus or preferably a continuous centrifuge where a sludge of crude potassium nitrate and tobacco solubles is recovered. The separator means may be refrigerated if desired. The potassium nitrate content of the sludge will generally be about 70 ± 20% on a "wet weight" basis. The denitrated liquid phase having a nitrate-nitrogen content of about 0.3 to 0.5% and containing desirable tobacco components may be returned to the reconstituted tobacco process.

The potassium nitrate sludge containing residual extract is slurried with water under flow control to reduce the viscosity of the mixture. The slurrying process may be carried out in a refrigerated mixing tank 13 equipped with a low shear mixer to facilitate dilution and removal of the residual extract liquor from the surface of the potassium nitrate crystals. The extract liquor is preferably diluted with chilled water. The extent of water dilution of the residual extract liquor is dependant on the desired purity of the potassium nitrate product. Generally, the mixture is diluted by about 40 to 60% with water. The temperature in the mixing tank is maintained at about 25° F. to 35° F. and preferably at about 30° F. to minimize the dissolution of potassium nitrate crystals.

The diluted, mixed slurry is then conducted to a second stage separator 14, such as a continuous centrifuge, where the washed potassium nitrate is recovered. The aqueous supernatant is recycled, preferably to the concentration process; however, some of the supernatant may be recycled to either the crystallizer 10 or the mixing tank 13, if desired. The potassium nitrate product may be dried, preferably in a rotary dryer, or otherwise treated for use as a fertilizer. The final product will generally contain about 91 ± 6% potassium nitrate on a dry weight basis in admixture with a small amount of the double salt of calcium potassium sulfate monohydrate and residual organic constituents.

The following examples are illustrative, but it will be understood that the invention is not limited thereto.

EXAMPLE 1

Burley stems were extracted with water and the aqueous fraction was separated from the fibrous tobacco residue and concentrated in vacuo with low temperature heating to a total solids content of 42%. The concentrated extract having a nitrate-nitrogen content of 1.8% was fed into a refrigerated crystallizer and cooled to 6° F. Following crystallization, the mixture was pumped to the first-stage centrifuge where the denitrated extract was separated from the crude potassium nitrate sludge. The denitrated extract was analyzed and shown to have a nitrate-nitrogen content of 0.4% representing a 77% reduction.

The crude sludge was fed to a refrigerated mixing tank where it was mixed with cold water to dilute the residual tobacco extract containing desirable tobacco solubles. The mixture was pumped to a second stage centrifuge where the washed potassium nitrate was recovered and dried. The tobacco extract supernatant was recycled to the concentration process.

The dried potassium nitrate product was analyzed and shown to be approximately 92% potassium nitrate on a dry weight basis in admixture with the double salt of calcium potassium sulfate monohydrate.

EXAMPLE 2

In a manner similar to Example 1, a concentrated tobacco extract was prepared from 90% Burley stems and 10% Burley lamina. The nitrate-nitrogen content of the extract was 1.6%, and the total solids content was 48%. Following denitration and separation from the potassium nitrate sludge, the concentrated extract had a nitrate-nitrogen content of 0.4% representing a 75% reduction and a total solids content of 43%.

The crude potassium nitrate sludge obtained above was processed as in Example 1, analyzed, and shown to have a purity of about 90%.

EXAMPLE 3

Utilizing the procedure of Example 1, a concentrated tobacco extract was prepared from 50% Burley stems and 50% non-Burley tobacco. The original nitrate-nitrogen content was 1.2%, and the total solids content was 52%. Following denitration and separation from the potassium nitrate sludge, the extract had a 0.4% nitrate-nitrogen content representing a 66% reduction, and the total solids were 50%. The sludge was processed as in Example 1 and found to have purity of approximately 90%.

EXAMPLE 4

The denitrated extracts obtained in Examples 1 through 3 were recombined with their respective fibrous tobacco residues which had been formed into paper-like sheets by ordinary papermaking techniques. As a control, reconstituted tobacco sheets were prepared in a similar manner except that the tobacco extracts were not treated to remove potassium nitrate.

The nitrate-nitrogen content of the reconstituted tobacco sheets was determined using a Technicon Autoanalyzer II system with a modification of the procedure as published by L. F. Kamphake et al., *International Journal of Air and Water Pollution*, 1, 205–216, 1976. The results of the testing were as follows:

Table 1

| Nitrate-Nitrogen ($NO_3$—N) of Reconstituted Sheets | | | | | |
|---|---|---|---|---|---|
| Example 1 | | Example 2 | | Example 3 | |
| 100% Burley Stems | | 90% Burley Stems | | 50% Burley Stems | |
| Control | Denitrated | Control | Denitrated | Control | Denitrated |
| 1.52 | 0.46 | 1.4 | 0.3 | 0.9 | 0.3 |

EXAMPLE 5

The tobacco sheet of Example 2 was shredded and made into cigarettes. Group A cigarettes contained 100% reconstituted tobacco, and Group B cigarettes contained approximately 18.0% reconstituted tobacco in admixture with a tobacco blend.

The cigarettes were smoked under controlled laboratory conditions, and the nitric oxide generated in the gas phase of the smoke was measured using an Aero Chem AA-2 Chemiluminescence Analyzer. The results of this testing are as follows:

Table 2

| | Control | Denitrated | % Reduction |
|---|---|---|---|
| 100% cigarettes | | | |
| $NO_3$—N | 1.25 | 0.32 | 74 |
| μg NO/cigarette | 570 | 200 | 65 |
| 18% Cigarettes | | | |
| $NO_3$—N | 0.34 | 0.24 | 30 |
| μg NO/cigarette | 380 | 220 | 43 |

EXAMPLE 6

A denitrated extract liquor was prepared from a mixture of tobacco scrap containing approximately 60% Burley stems in the manner described in Example 1. The denitrated liquor was recombined with the tobacco residue to form a reconstituted sheet. A control sheet was prepared in a similar manner using untreated extract liquor. The sheets were shredded, made into cigarettes, and smoked according to the method of Example 5. The results of the testing are as follows:

Table 3

| | Control | Denitrated | % Reduction |
|---|---|---|---|
| 100% cigarettes | | | |
| $NO_3$—N | 1.19 | 0.39 | 67 |
| μg NO/cigarette | 790 | 260 | 67 |
| 18% cigarettes | | | |
| $NO_3$—N | 0.36 | 0.23 | 36 |
| μg NO/cigarette | 350 | 230 | 34 |

Test results of the above-cited examples show that reconstituted tobacco sheets which have been treated during processing to remove potassium nitrate contain less nitrate-nitrogen than untreated sheets and, on smoking, deliver a decreased amount of nitrogen oxide.

EXAMPLE 7

A typical tobacco blend containing Burley components was processed on a continuous basis for 48 hours to demonstrate the feasibility of a large scale operation using the procedure of this invention. Table 4 illustrates in detail the materials balance of each process stream during the extended run. Stream 1 represents the tobacco extract following concentration; stream 2, denitrated extract effluent from the first stage centrifuge; stream 3, crude potassium nitrate sludge from the first stage centrifuge; stream 4, potassium nitrate slurry exiting from the mixing tank; steam 5, washed potassium nitrate from the second stage centrifuge; and steam 6, extract supernatant from second stage centrifuge which is recycled to the concentration process. Potassium nitrate content was determined on a "wet weight" basis.

Table 4

| Stream | 1 | 2 | 3 | 4 | 5 | 6 |
|---|---|---|---|---|---|---|
| Total Solids, lbs/hr | 163.0 | 140.0 | 23.0 | 23.0 | 15.0 | 8.0 |
| Potassium Nitrate, lb/hr | 29.0 | 11.0 | 18.0 | 18.0 | 14.0 | 4.0 |
| Water, lbs/hr | 155.0 | 152.0 | 4.0 | 21.0 | 2.0 | 20.0 |
| Total, lbs/hr | 319.0 | 292.0 | 27.0 | 44.0 | 17.0 | 29.0 |
| Total, gal/hr | 30.0 | 30.0 | — | 4.0 | — | 4.0 |
| Potassium Nitrate, % | 9.2 | 4.0 | 69.3 | 40.9 | 83.7 | 14.4 |
| Total Solids, % | 51.2 | 47.7 | 87.1 | 52.2 | 91.3 | 29.2 |
| Temperature, ° F | 107.0 | 40.0 | — | 42.0 | — | 46.0 |

Representative samples of the potassium nitrate crystalline product recovered during the 48 hour run were dried and analyzed. The statistical analysis of the composition of the potassium nitrate product represents an average derived from a series of determinations:

| | |
|---|---|
| Potassium Nitrate* | 91.60% |
| Sulfate | 4.50% |
| Potassium (excess) | 0.44% |
| Phosphate | 0.30% |
| Calcium | 1.10% |
| Sodium | 0.06% |
| Chloride | 0.20% |
| Silica | 0.30% |
| Organics | 1.50% |

*Determined on the basis of nitrate-nitrogen content.

What is claimed is:

1. In a process for preparing reconstituted tobacco, including the steps of providing an aqueous extract of tobacco plant part solubles, separating the insoluble fibrous tobacco residue from the aqueous extract, and forming said residue into a paper-like sheet, the improvement which comprises:

(a) concentrating the aqueous extract under vacuum to a total solids content between about 30–70 percent;

(b) cooling the extract to a temperature between about 5°–25° F. to effect crystallization of potassium nitrate;

(c) separating and recovering a crystalline potassium nitrate sludge and a denitrated extract phase; and (d) recombining the denitrated extract phase with the paper-like sheet of tobacco, wherein the said extract phase has a nitrate-nitrogen content of about 0.3–0.5 percent.

* * * * *